US007135972B2

(12) United States Patent
Bonato

(10) Patent No.: US 7,135,972 B2
(45) Date of Patent: Nov. 14, 2006

(54) ANTI-THEFT DEVICE PARTICULARLY FOR POINT OF SALE DISPLAYS

(76) Inventor: Ferruccio Bonato, Via Monte Carega, 4/6, 37019 Peschiera del Garda (IT)

( * ) Notice: Subject to any disclaimer, the term of this patent is extended or adjusted under 35 U.S.C. 154(b) by 0 days.

(21) Appl. No.: 10/476,227

(22) PCT Filed: Apr. 25, 2002

(86) PCT No.: PCT/EP02/04608

§ 371 (c)(1),
(2), (4) Date: Oct. 29, 2003

(87) PCT Pub. No.: WO02/090693

PCT Pub. Date: Nov. 14, 2002

(65) Prior Publication Data

US 2004/0150524 A1 Aug. 5, 2004

(30) Foreign Application Priority Data

May 3, 2001 (IT) ..... VR01A0052

(51) Int. Cl.
*G08B 13/12* (2006.01)
*G08B 13/14* (2006.01)

(52) U.S. Cl. ..... 340/568.2; 340/568.1; 340/568.8; 340/531; 242/373

(58) Field of Classification Search ..... 340/568.1, 340/568.2, 568.8, 531
See application file for complete search history.

(56) References Cited

U.S. PATENT DOCUMENTS 4,488,764 A * 12/1984 Pfenning et al. ..... 439/133
4,923,153 A * 5/1990 Matsui et al. ..... 248/74.1
5,072,213 A * 12/1991 Close ..... 340/568.2
5,124,685 A 6/1992 Rankin
5,172,098 A * 12/1992 Leyden et al. ..... 340/568.2
5,552,771 A * 9/1996 Leyden et al. ..... 340/568.2
5,685,436 A 11/1997 Davet
6,039,496 A 3/2000 Bishop
6,419,175 B1 * 7/2002 Rankin, VI ..... 242/373
6,476,717 B1 * 11/2002 Gross et al. ..... 340/568.1
6,828,909 B1 * 12/2004 Script et al. ..... 340/545.1

FOREIGN PATENT DOCUMENTS

DE U-298 12 378 4/1999
GB A-2 254 719 10/1992

* cited by examiner

*Primary Examiner*—Daniel Wu
*Assistant Examiner*—Samuel J Walk
(74) *Attorney, Agent, or Firm*—Modiano & Associati; Albert Josif; Daniel O'Byrne

(57) ABSTRACT

An anti-theft device, comprising at least one spool (2) made of electrically insulating material that is mounted rotatably on a support (3); a cable-like element (4) that can be wound onto, and unwound from, the spool or a respective spool and has a free end (5) that can be detachably anchored to an item (6) to be restrained, elastic loading means for the or each spool in order to ensure the automatic tensioning and rewinding of said cable-like element on its own spool, detachable engagement means for an item to be restrained which are located at the free end of said cable-like element or of each cable-like element and are suitable to open or close an electrical contact, and a control unit (8) that is meant to act in response to the opening-closing of the electrical contact.

53 Claims, 7 Drawing Sheets

ANTI-THEFT DEVICE PARTICULARLY FOR POINT OF SALE DISPLAYS

BACKGROUND OF THE INVENTION

The present invention relates to an anti-theft device particularly but not exclusively suitable for use in association with displays of goods for sale, such as for example eyeglasses, jewels, watches, items of clothing, tools, and many others.

It is known that it would be desirable to be able to allow customers of a sales center or shop to pick up, handle, and possibly try goods before deciding whether to buy them or not, but this generally clashes with the need to ensure that the goods are not stolen and taken away without paying. Anti-theft tags have already been proposed; however, they are suitable only for indoor environments, where it is possible to provide adequate verification on the part of assigned personnel, but they can give no assurance against theft in open-air exhibitions, for example on a shop frontage. Moreover, anti-theft tags are constituted in many cases by devices that must be broken in order to release the item on sale, and this forces the retailer to continuously acquire new devices, with an increase in sales costs.

SUMMARY OF THE INVENTION

The aim of the present invention is to eliminate or drastically reduce the difficulties encountered with conventional anti-theft devices, by providing an anti-theft device capable of forcing the customer or patron to return the item after picking it up and handling it.

Within this aim, an object of the present invention is to provide an anti-theft device that can be reused and is capable not only of restraining the items on display with respect to an anchoring base but also of activating, if appropriate, an alarm system, optionally of the remote type.

Another object of the present invention is to provide a new type of stand provided with the anti-theft device according to the invention.

This aim and these and other objects that will become better apparent hereinafter are achieved by an anti-theft device according to the invention, comprising at least one spool mounted rotatably on a support, a cable-like element that can be wound onto, and unwound from, said spool or a respective spool and has a free end that can be detachably anchored to an item to be restrained, elastic loading means for the or each spool in order to ensure the automatic tensioning and rewinding of said cable-like element on its own spool, detachable engagement means for an item to be restrained which are located at said free end of said cable-like element or of each cable-like element and are suitable to open or close an electrical contact, and a control unit adapted to act in response to the opening-closing of said electrical contact.

Advantageously, the control unit comprises remote transmission means for activating a remote signaling or alarm system.

According to another aspect, the present invention provides an anti-theft device, characterized in that it comprises at least one flexible cable which has two conducting wires connected, at a first end, to means for detachable engagement with at least one item to be restrained, which are suitable to open or close an electrical contact between said two conducting wires and are connected, at their other end, to a control unit meant to act in response to the opening/closure of said electrical contact, said detachable engagement means comprising a clamping element in order to lock, with respect to said first end, a portion of said cable in order to form a restraining loop.

BRIEF DESCRIPTION OF THE DRAWINGS

Further characteristics and advantages of the present invention will become better apparent from the following detailed description of some embodiments of the anti-theft device according to the invention, given with reference to the accompanying drawings, wherein.

DESCRIPTION OF THE PREFERRED EMBODIMENTS

Figure 1:
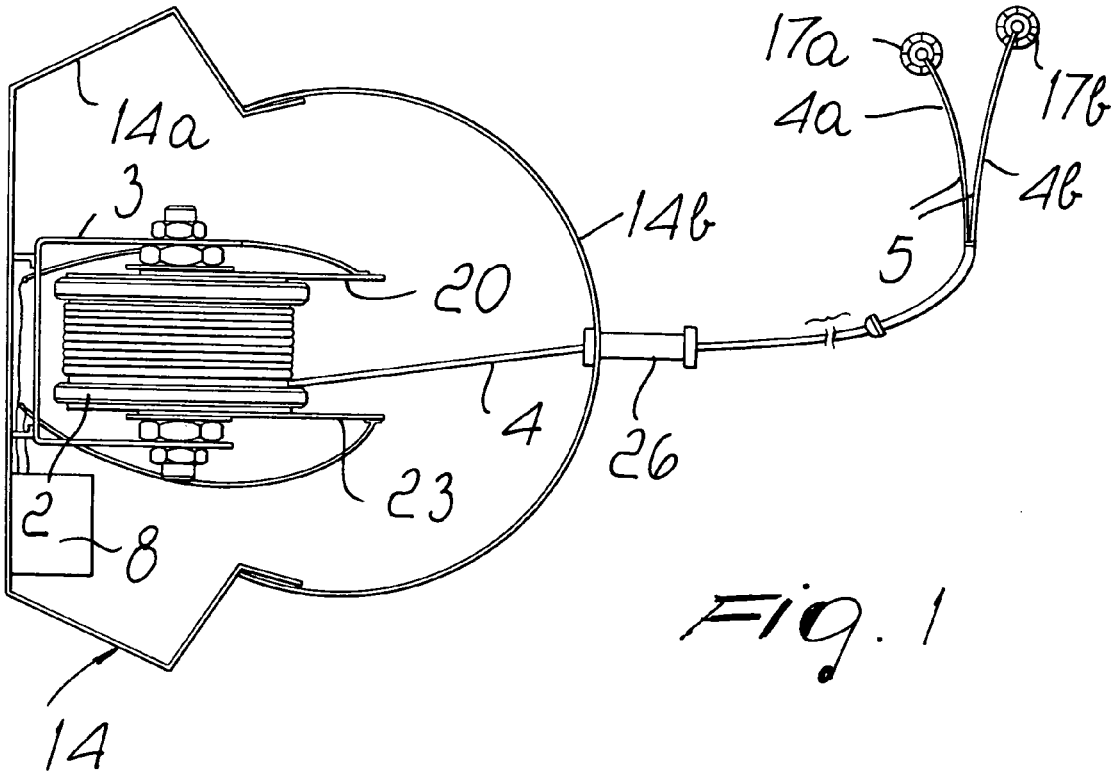
FIG. 1 is a top view of a first example of stand provided with an anti-theft device according to the invention.
Figure 2:
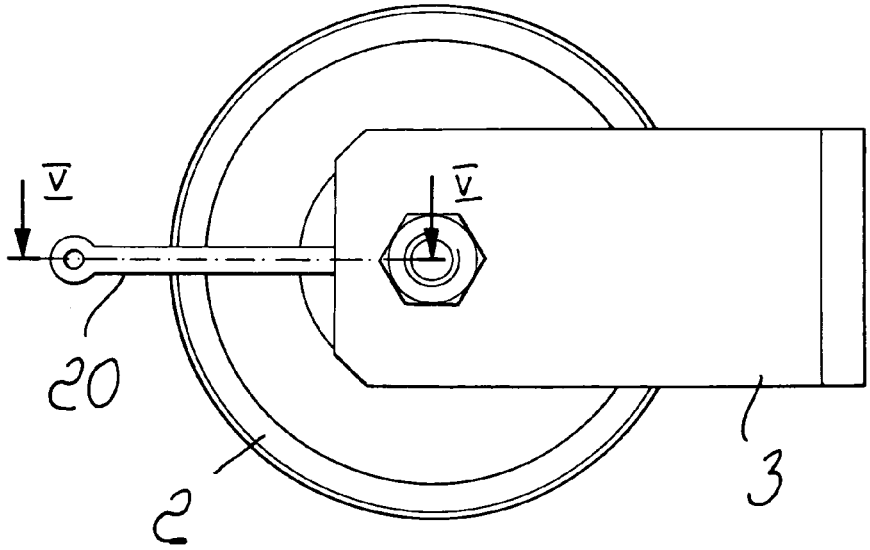
FIG. 2 is a side view of a spool mounted rotatably on a U-shaped bracket of the anti-theft device of FIG. 1.

With reference to the figures, it is clearly shown that an anti-theft device 1 according to the invention is formed by: at least one spool 2, which is rotatably mounted on a support 3; a cable-like element 4, which can be wound onto, and unwound from, the spool 2 and has a free end 5 that can be detachably anchored to an item 6 to be restrained; an elastic loading spring 7 for the spool 2, in order to keep the cable-like element 4 tensioned and rewind it automatically on the spool 2; means for detachable engagement with an item 6 to be restrained, which are arranged at the free end of the wire or cable 4 and are suitable to open or close an electrical contact; and a remote control unit 8, meant to generate control signals for an alarm device (not shown), which can be of the acoustic, luminous or other kind and is preferably located remotely, for example inside a shop, if the anti-theft device is located outside on the frontage, obviously if the electrical circuit is opened or closed due to an attempted theft.

Figure 3:
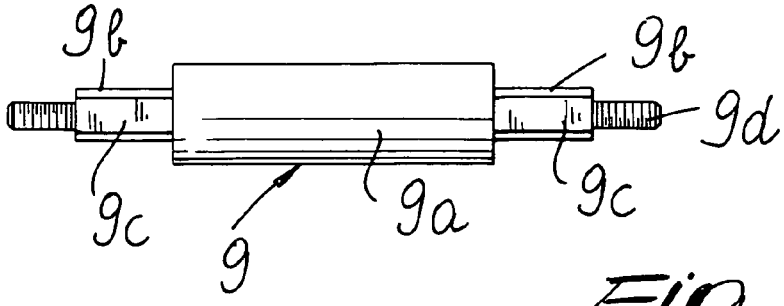
FIG. 3 is a view of the supporting shaft of the spool of FIG. 2.
Figure 4:
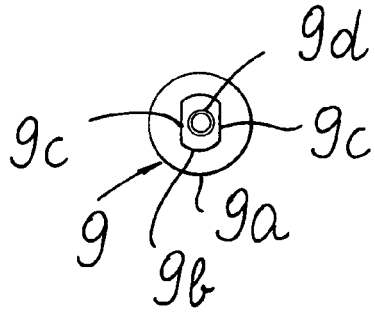
FIG. 4 is a side view of the shaft of FIG. 3.

As shown more clearly in FIGS. 2 to 6, the spool 2 is mounted so that it can rotate about a shaft 9, which can have a cylindrical central portion 9*a*, two intermediate portions 9*b* with two diametrically opposite flat regions and two threaded end portions 9*d* (as shown in FIGS. 3 and 4). More specifically, the spool 2 is thus supported at the cylindrical central portion 9*a* of the shaft 9 and is flanked in any case by two lateral metallic plates 10, each of which can have a slotted opening 10*a* (FIG. 7) that allows mounting on a respective flat intermediate portion 9*b* of the shaft 9, so that it cannot rotate thereon.

Two fixing washers 11 can be applied against the lateral plates 10 and are clamped by a respective nut 12, which can be screwed onto a threaded end portion 9*d* of the shaft. The perforated ends of a supporting bracket 3 are fitted externally with respect to the nuts 12; such bracket is for example U-shaped, and the ends are in turn fixed in position by two external nuts 13. The bracket 3 is in turn fixed, for example welded, as shown more clearly in FIG. 1, within a hollow post 14, which is preferably formed by two folded pieces of metal plate, for example made of stainless steel, and is constituted by a rear supporting portion 14*a* and by a front piece 14*b* that can be inserted with a snap action on the rear portion, so that the spool is preferably hidden from sight.

Figure 5:
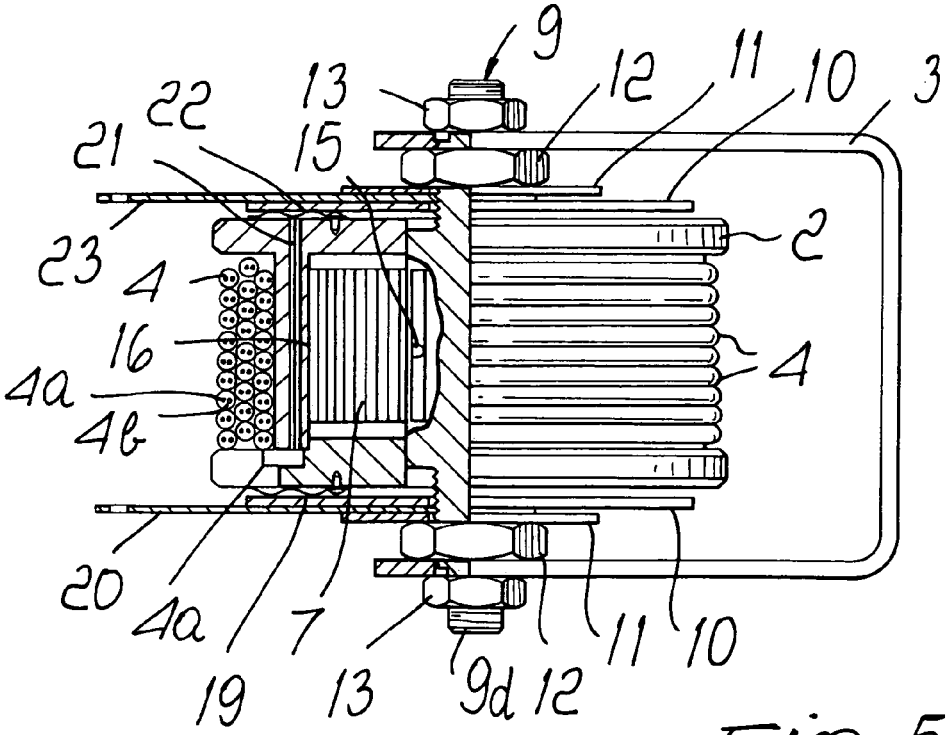
FIG. 5 is a top view, with parts shown in cross-section along the line V—V of FIG. 2, of a first embodiment of the anti-theft device according to the invention.
Figure 6:
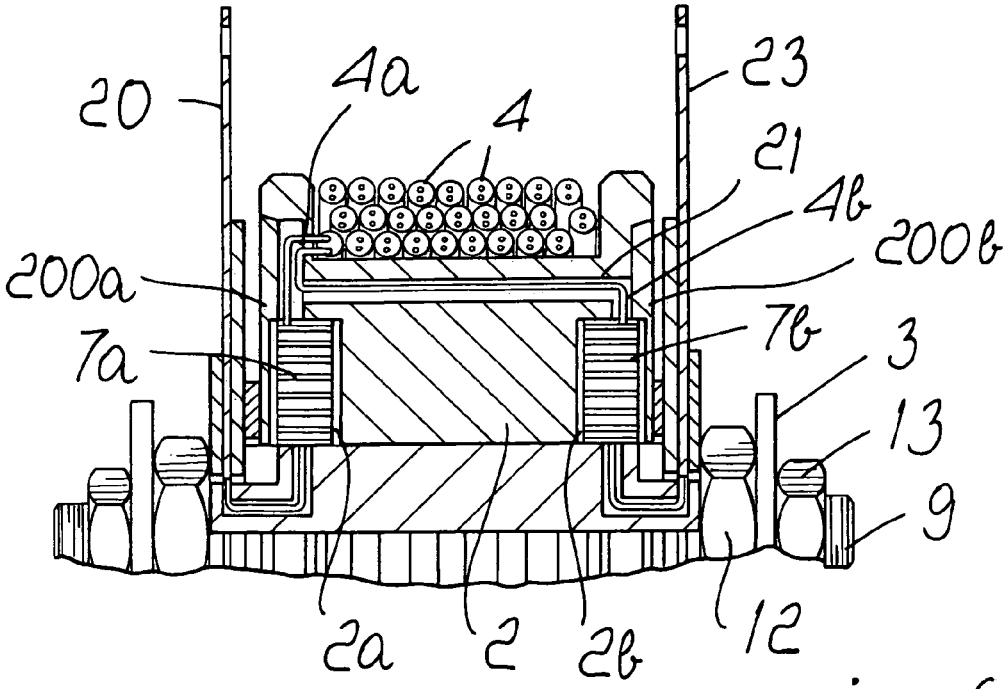
FIG. 6 is a view, similar to FIG. 5, but related to another embodiment of the anti-theft device without sliding contacts.

The spool 2 is constituted by electrically insulating material and is internally hollow in order to accommodate the coiled spring 7, in the example shown in FIG. 5, or two coiled springs 7*a* and 7*b*, as shown in FIG. 6.

The cord 4 is in actual fact a very thin flexible cable which has a high pulling strength and internally contains two conducting wires 4*a* and 4*b*, each of which is constituted for example by seven strands of conducting filament with a diameter of 0.03 mm enclosed in a sheath, while the two sheathed wires are in turn sheathed in an insulating sheath, made for example of PVC (polyvinyl chloride), so as to constitute a cable with an average diameter of 0.6 mm.

Figure 7:
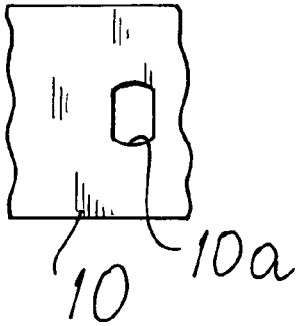
FIG. 7 is a view of a detail of a supporting bracket of the shaft of FIG. 3.
Figure 8:
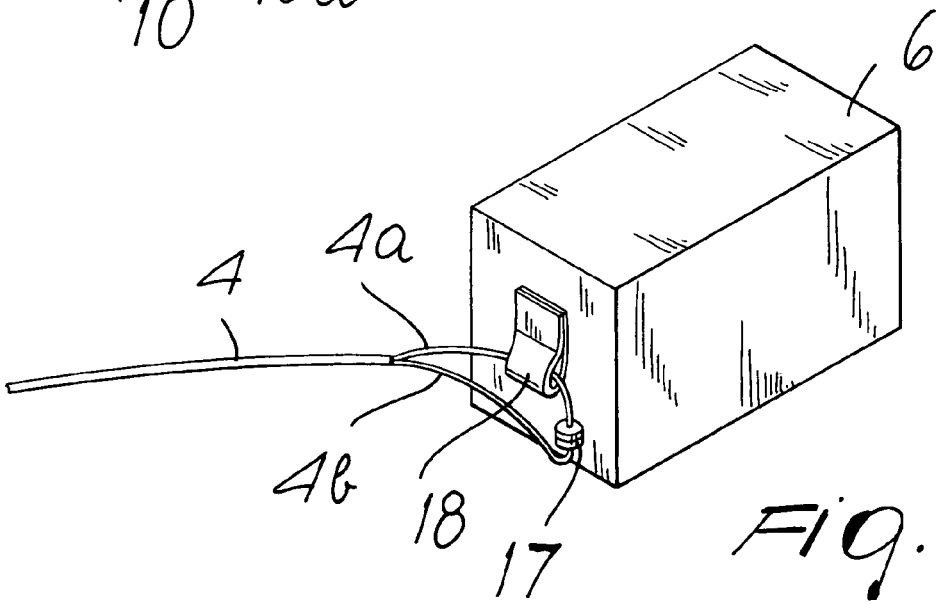
FIG. 8 is a view of an example of means for detachable engagement between the cord or cable-like element and an item to be restrained that is provided with an eye or slotted hole.

As shown in FIG. 8, the cable 4 ends, at its free (outer) end, for example with its conducting wires 4*a* and 4*b* connected electrically to a respective half 17*a* and 17*b* of a metallic security stud 17 in order to detachably restrain, preferably in a noose-like fashion, as shown in FIG. 7, an item 6 that is provided with an engagement hole 18 or can be otherwise surrounded by the two conducting wires 4*a* and 4*b*.

In the case of the embodiment shown in FIG. 5, the spring 7 has an (inner) end fixed at 15 to the shaft 9 and its other end anchored to the spool at 16.

In order to supply power to the electrical circuit that can be opened at the security stud 17, the internal end of the cable 4 is connected, by means of its own conductor 4*a*, to a spring or elastic sliding shoe 19, which is fixed to an outer side of the spool 2 and is in sliding electrical contact with the plate 10 and therefore also with an electrical contact that is clamped between the plate 10 and the washer 11 and protrudes from the spool. The conductor 4*b* is instead connected electrically, along an axial hole 21 formed in the spool 2, to a spring or elastic sliding contact 22 that is fixed on the other side of the spool 2 and is in electrical contact, by means of the respective plate 10, with an electrical contact 23. In turn the contacts or terminals 20 and 23 are electrically connected to the control unit 8 (for example a controller with an electronic board), FIG. 1.

In the embodiment shown in FIG. 6, the spool 2 has two coaxial lateral seats 2*a* and 2*b* with a plurality of diameters, which accommodate a respective coiled spring 7*a* and 7*b*. Each spring 7*a* and 7*b* has an end that is anchored to the spool 2, while the other end reacts against the shaft 9. Each seat 2*a* and 2*b* is closed, in use, by a respective annular cover 200*a*, 200*b*, which can be fitted on the shaft 9. A conducting wire 4*a* of the cable 4 is electrically connected to the external end of the spring 7*a*, while the other conducting wire 4*b* is connected electrically, for example by passing along an axial hole 21 or in another suitable manner, to the outer end of the spring 7*b*. The springs 7*a* and 7*b* are in turn electrically connected at their inner end to the respective terminal 20 and 23.

It is easy to notice that in this embodiment all sliding contact is eliminated; such contact, due to dust and oxidation phenomena, can cause sparking, rapid discharge of the batteries that supply power to the controller 8, et cetera.

Figure 9:
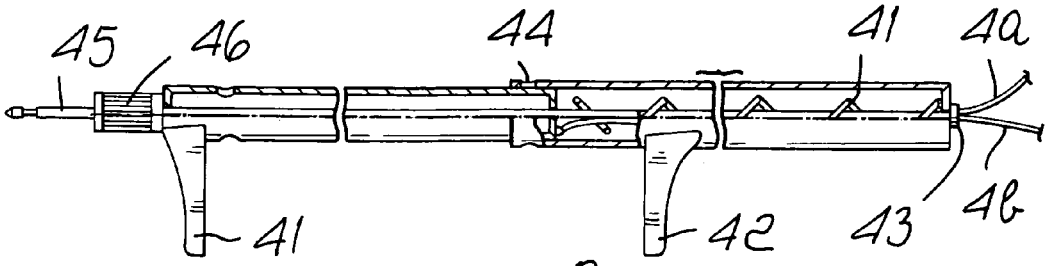
FIG. 9 is a view, with some parts shown in cross-section, of another embodiment of engagement means in the inactive or idle position.
Figure 10:
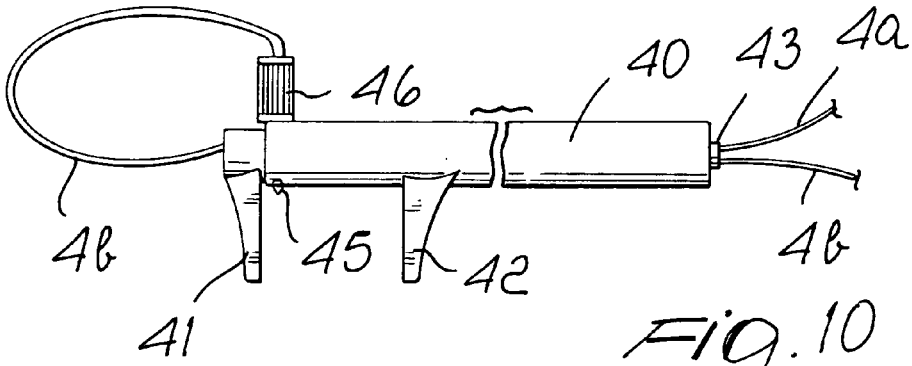
FIG. 10 is a view of the engagement means of FIG. 9 in the active position.
Figure 11:
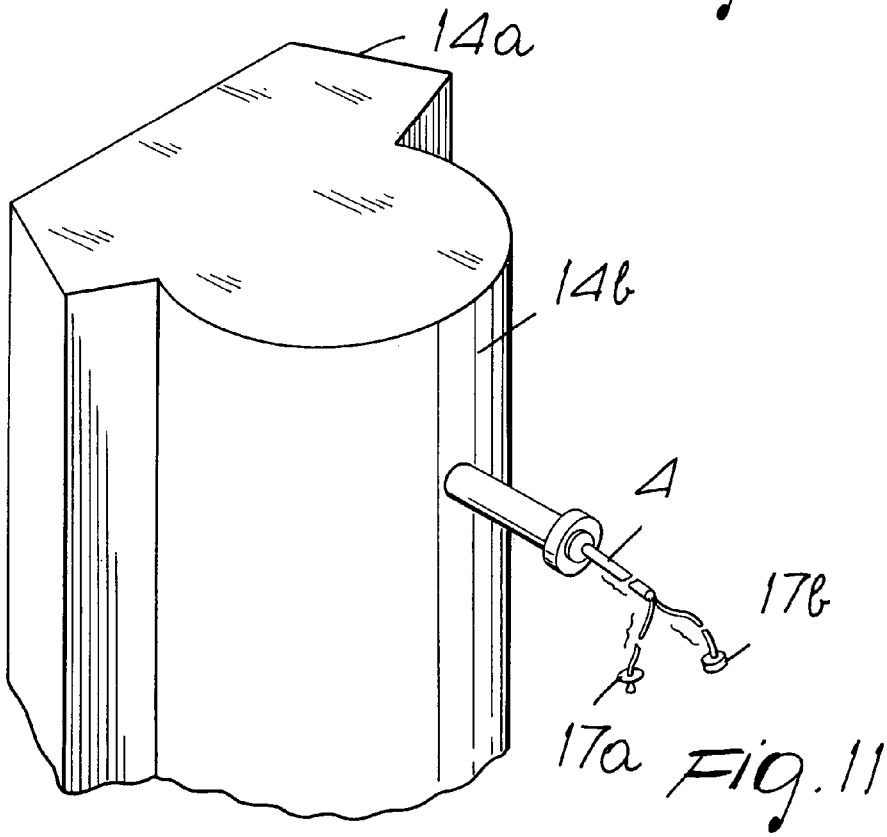
FIG. 11 is a perspective view of a portion of a column-like tubular stand, which includes a plurality of anti-theft devices according to the invention arranged one above the other.
Figure 12:
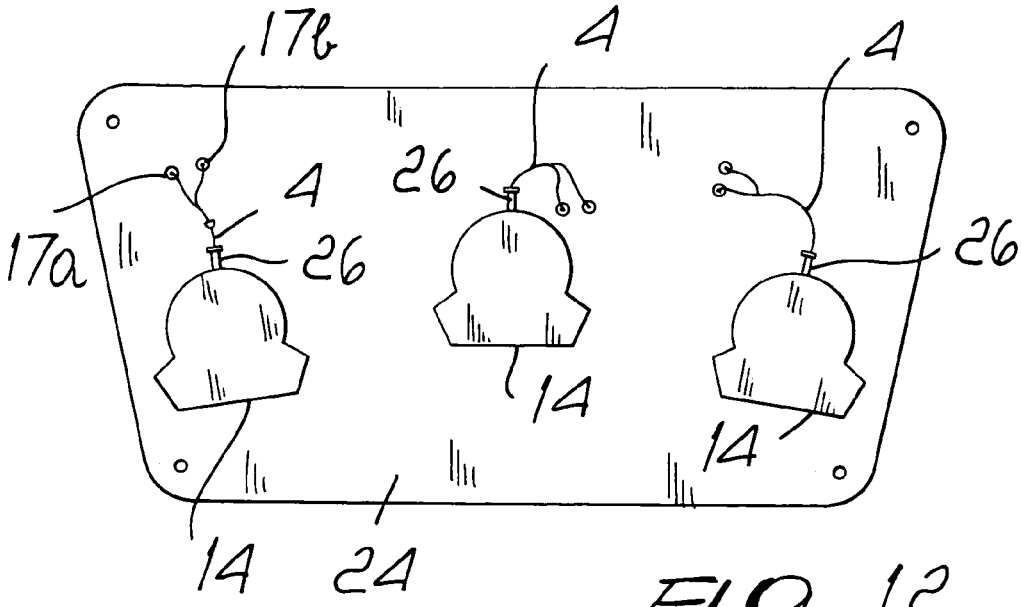
FIGS. 12 and 13 are two reduced-scale top views of a corresponding number of stands with a plurality of tubular columns.
Figure 13:
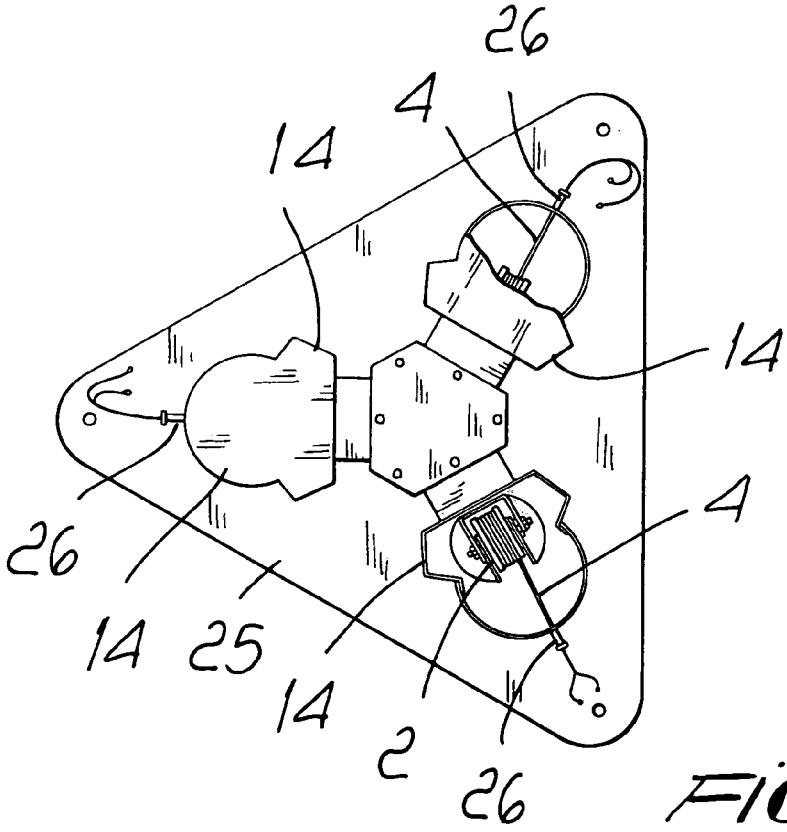

FIGS. 9 and 10 illustrate a retention device 40, which constitutes an alternative to the press-stud 17 and is constituted by a telescopic tube loaded by a spring 41. Preferably, the telescopic tube has two grips or external protrusions 41 and 42 for more comfortable grip and compression on the part of two fingers of the user's hand.

The cable 4, inserted in a bush 43, reaches one end of the telescopic tube. The conducting wire 4*a* of the cable is connected electrically to one or both ends of a transverse hole 44 formed in the telescopic tube. The other conducting wire 4*b* instead runs along the entire length of the telescopic tube, from which it protrudes and ends with a small plug 45 provided with a head 46 that is larger than the internal passage of the telescopic tube, so that it cannot enter said tube.

When the tube is compressed or shortened, the wire 4*b* can form a noose (FIG. 10) for winding around, or anchoring to, an item 6 to be restrained, and the plug 45 can be inserted in the hole 44 in order to close an electrical circuit, in a manner that is fully similar to the press-stud 17.

Figure 14:
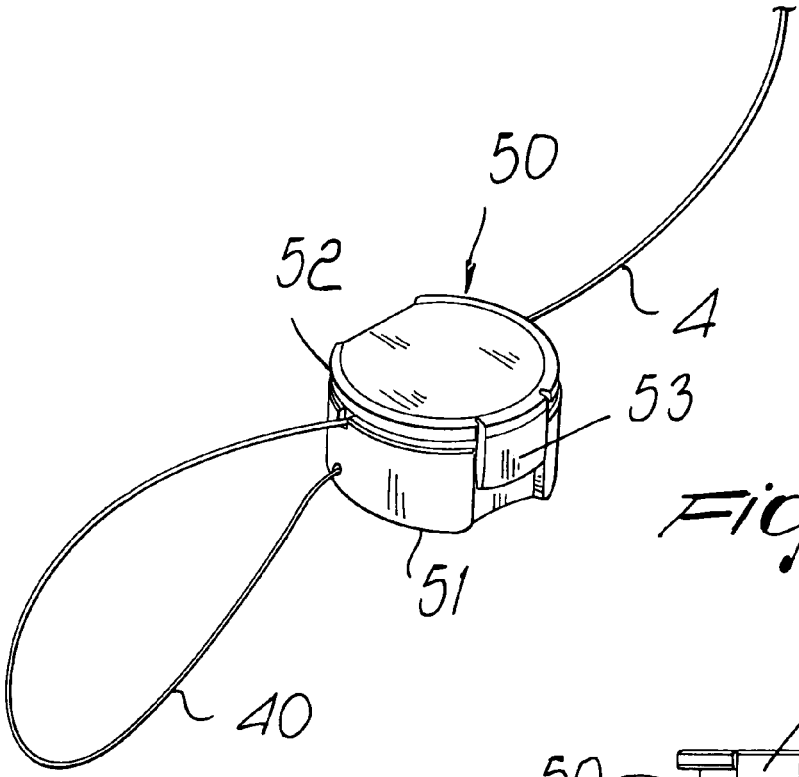
FIG. 14 is a perspective view of a second embodiment of the engagement means.
Figure 15:
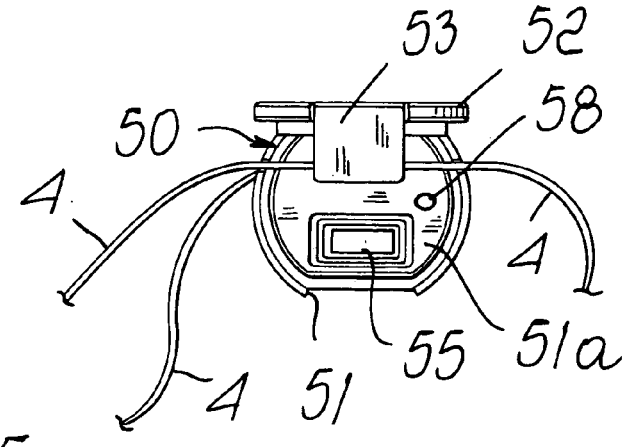
FIG. 15 is a top view of the engagement means of FIG. 14 in the open condition.
Figure 16:
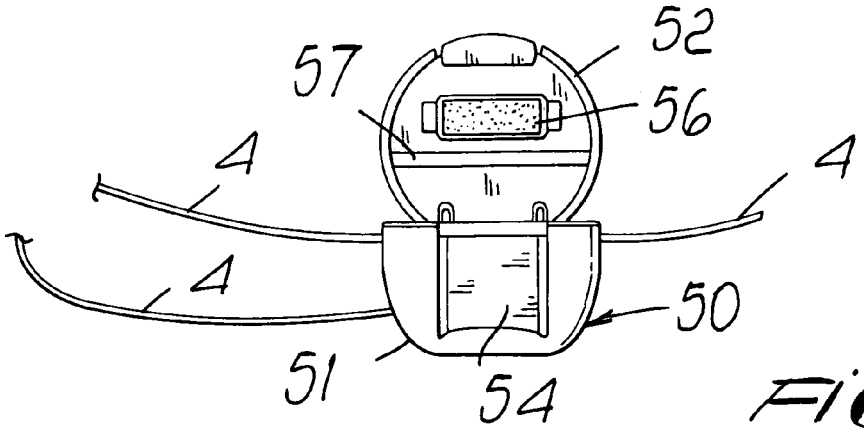
FIG. 16 is an elevation view of the engagement means of FIG. 15.

FIGS. 14 to 16 illustrate a particular embodiment of the detachable engagement means of the device according to the invention.

In particular, these detachable engagement means comprise a clamping element 50, which is meant to lock a portion of the cable 4 in order to form a restraining loop 40.

Advantageously, the clamping element 50 is constituted by a first jaw 51 and a second jaw 52, which are mutually articulated in order to pass from an engaged condition, in which the portion of the cable 4 can move with respect to the first end (or free end) of the two conducting wires, and a restraining condition, in which the portion of the cable 4 is in the locking position and the electrical contact between the two conducting wires is closed.

Conveniently, as shown in FIGS. 14 to 16, the conducting wires 4a and 4*b* are both connected to the first jaw 51.

The first jaw 51 and the second jaw 52 are mutually articulated and are provided with mutual engagement means, such as for example an engagement tooth 53, which is arranged at the second jaw 52, and a locator 54, which is supported by the first jaw 51.

As shown more clearly in FIG. 15, the first jaw 51 has, at its surface that is meant to face, in the restraining condition, the second jaw 52, a button 55 which is meant, in the restraining condition, to be pressed and thus close the electrical contact between the two conducting wires 4*a* and 4*b*.

The second jaw 52 has, at the surface that faces the first jaw 51 in the restraining condition, a slot 57 that is meant to accommodate the portion of the cable 4 to be clamped between the two jaws 51 and 52.

According to the invention, the first jaw 51 has a surface 51*a* which is meant to face the second jaw 52 in the restraining condition; the surface 51*a* is provided with means for adjusting the distance from the second jaw 52 in the restraining condition, and in the embodiment shown in FIGS. 14 to 16, said means are constituted by a screw 58.

Advantageously, the second jaw 52 has, on the face that is meant to face the first jaw 51, a protrusion 56 for facilitating the pressing of the button 55.

As shown more clearly in FIG. 14, if the device is in the restraining condition, with the cable 4 correctly accommodated within the slot 57, the sliding of the cable 4 is not allowed if the device is not opened, consequently opening the electrical contact between the conducting wires 4*a* and 4*b*. Before closing the contact, instead, it is possible to slide the cable 4 in order to restrain in an optimum manner the item 6 to the detachable engagement means.

In particular, the perfect adhesion of the wire to the face 51*a* and to the cover is ensured because it is possible, by acting on the adjustment means 58, to vary the distance, in the closed condition, between the face 51*a* and the cover, thus appropriately clamping the cable 4 between the two jaws 51 and 52.

Moreover, by varying such distance, the user can adjust the pressure applied by the cover to the button 55, so as to produce optimum closure of the contact between the wires 4*a* and 4*b* of the cable.

Although the cable 4 has a protective sheath that is rather yielding (and has a so-called "memory effect"), the mutual clamping of the two jaws 51 and 52 might cause, in the long term, a deterioration, if not of the functional characteristics, at least of the outward appearance of the cable 4.

Figure 17:
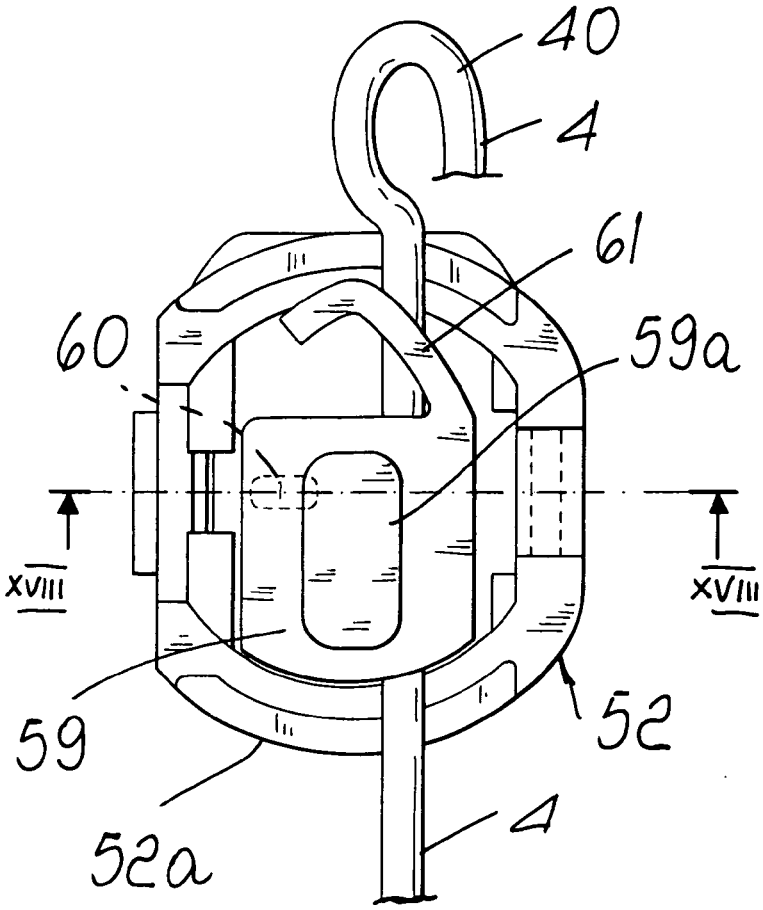
FIG. 17 is a top view of a particular embodiment of the engagement means of FIGS. 14 to 16.
Figure 18:
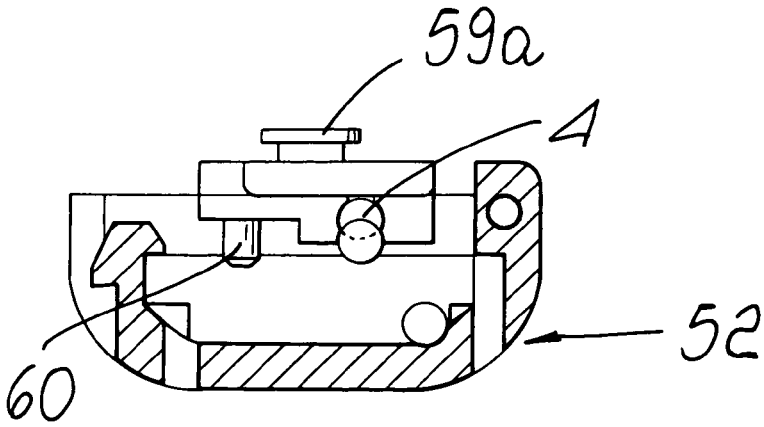
FIG. 18 is a sectional view, taken along the line XVIIII-XVIII of FIG. 17.

In order to obviate this drawback, as shown more clearly in FIGS. 17 and 18, the portion of the cable 4 that in the restraining condition is clamped between the two jaws 51 and 52 is at least partially associated with a lamina 59 for closing the electrical contact, which is supported for example by the second jaw 52.

In greater detail, in this embodiment the lamina 59 supports, on one face, a button 59*a*, which in the restraining condition is suitable to abut, for example, against a button 55 (or a similar element) formed on the first jaw 51, so as to close the electrical contact between the two conducting wires 4*a* and 4*b*, which are conveniently connected to the first jaw 51.

In particular, the button 59a closes the electrical contact when the lamina 59 is substantially adjacent to the end 52*a* of the jaw 52 and is therefore in a distal position with respect to the restraining loop 40.

The lamina 59 has, advantageously on the face that lies opposite to the one provided with the button 59*a*, a pin 60, which can slide within a slot formed in the second jaw 52, thus slidingly associating the lamina 59 with the second jaw 52.

Conveniently, an elastically yielding element 61 is interposed between the lamina 59 and the second jaw 52, acts along a direction that is substantially parallel to the sliding direction of the lamina 59, and is meant to keep the lamina 59 adjacent to the end 52*a* of the jaw 52, so as to ensure in normal operating conditions, i.e., in restraining conditions, the closure of the electrical contact between the conducting wires 4*a* and 4*b*.

The portion of the cable 4 clamped between the two jaws 51 and 52 passes between the lamina 59 and the jaw 52, making contact, at least in its intermediate portion, with the lamina 59.

If one attempts to widen the restraining loop 40, the sliding of the portion of cable 4 clamped between the jaws 51 and 52 causes the movement of the lamina 59 toward the end of the jaw 52 that lies proximate to the restraining loop 40 and accordingly shifts the position of the button 55 with respect to the first jaw 51, interrupting the electrical contact between the cables 4*a* and 4*b*, which are connected, in this embodiment, to the first jaw 52.

Another possibility for preventing any widening of the loop 40 due to the sliding of the cable 4 is to keep loose the free end of one of the two conducting wires, for example the conducting wire 4*a*, so that any traction of the cable 4 acts only on the other conducting wire, in the specific case the conducting wire 4*b*, increasing the probability of breakage of said wire and the consequent opening of the electrical contact.

Optionally, the detachable connection means comprise an indicator, constituted for example by a LED, which is suitable to indicate operating anomalies.

Moreover, it is also possible to use an anti-theft device 1 according to the invention that is constituted exclusively by a flexible cable 4 (or a plurality of cables 4) with two conducting wires 4*a* and 4*b* which are connected, at a first end, to means for detachable engagement with at least one item to be restrained and are suitable to open or close an electrical contact between said two conducting wires.

At the other end, the conducting wires 4*a* and 4*b* are connected, as described above, to a control unit that is meant to act in response to the opening/closure of said electrical contact.

In greater detail, the detachable engagement means are constituted by a clamping element 50, which is fully similar to the one described above, for locking, with respect to the first end, a portion of said cable, thus forming a restraining loop 40.

The operation of the anti-theft device according to the invention is very simple and safe. The customer can comfortably pick up the item 6, for example a pair of eyeglasses, a jewel, et cetera, examine it closely by pulling it toward himself, thus causing the unwinding of the cable 4 from the spool. If he decides not to make the purchase, he can return it to its place without the cable becoming tangled or other problems, since the cable is kept (gently) tensioned and winds up automatically as soon as the customer moves the item toward the spool or toward an appropriate stand for displaying the object, located proximate to the spool 2.

If instead a customer attempts theft after picking up an item coupled to the device, he is forced to break the restraint produced by the press-stud 17 or by the retainer 40 or to break the cable 4 or one of its wires 4*a* and 4*b*, and therefore the controller or control unit 8, as a consequence of the opening of the electrical circuit of which the conducting wires 4*a* and 4*b* are part, immediately activates an alarm system or other anti-theft device (for example a siren, a flashing light, a still or video camera) by emitting appropriate control signals.

As clearly shown by FIGS. 9 and 10, a plurality of anti-theft devices 1 can be installed in a same stand. Such can assume various configurations and can be arranged both vertically and horizontally. FIG. 9 shows a stand with three side-by-side columns on a common trapezoidal support 24, while FIG. 10 illustrates a star-shaped with three column-like stands arranged radially at 120° to each other on a triangular support 25. In any case, the cable 4 exits from the front 14*b* of the stand through a guiding bush 26, which for example in the case of a stand of eyeglasses can also act as a support for said eyeglasses.

Conveniently, a per se known adhesive tab can be associated with the clamping element 50 in order to allow to couple to the cable 4 items that have no temples or rings.

Advantageously, it is possible to use control means, such as for example a computer, that allow to monitor and store information related to the different frequency of trial by users of the various models of items connected to the anti-theft device.

The invention described above is susceptible of numerous modifications and variations within the protective scope defined by the content of the appended claims.

The disclosures in Italian Patent Application No. VR2001A000052 from which this application claims priority are incorporated herein by reference.

The invention claimed is:

1. An anti-theft device; comprising at least one spool made of electrically insulating material that is mounted rotatably on a support; at least one cable that can be wound onto, and unwound from, said spool or a respective spool and has a free end that can be detachably anchored to an item to be restrained, elastic loading means for the or each spool in order to ensure the automatic tensioning and rewinding of said cable on its own spool, detachable engagement means for an item to be restrained which is located at said free end of said cable or of each cable and is suitable to open or close an electrical contact, and a control unit that is meant to act in response to the opening-closing of said electrical contact, wherein said detachable engagement means comprises a clamping element having two clamping jaws which are mutually articulated in order to pass from an engagement condition, in which said portion of said cable can move with respect to a first end, to a restraining condition, in which said portion of said cable is in a locking position and said electrical contact is closed.

2. The device according to claim 1, wherein said cable has a high pulling strength and comprises two conducting wires, which end, at the free end of said cable, with a respective mutual engagement means.

3. The device according to claim 2, wherein each conducting wire of said cable comprises a plurality of strands having a very small diameter and an insulation and protection sheath.

4. The device according to claim 1, wherein said cable, said elastic loading means, said detachable engagement means and said control unit constitute an electric circuit that can be opened/closed at said detachable engagement means.

5. The anti-theft device according to claim 1, wherein said conducting wires are connected to a first one of said two jaws.

6. The anti-theft device according to claim 5, wherein said portion of said cable, in the restraining condition, is at least partially associated with a closure lamina that is slidingly coupled to a second jaw, a sliding of said portion of said cable suitable to widen said restraining loop producing a sliding of said lamina and the opening of said electrical contact.

7. The anti-theft device according to claim 6, wherein said lamina comprises, at the face that is meant to face said first jaw, a stud for engaging a button, formed on said second jaw, for closing said electrical contact.

8. The anti-theft device according to claim 7, further comprising elastic means that are interposed between said lamina and said second jaw, act along a direction that is substantially parallel to the direction of the sliding of said lamina with respect to said second jaw, and are meant to keep said lamina, in the restraining condition, in the position for closing said electrical contact.

9. The device according to claim 1, wherein said first jaw comprises, at the surface meant to abut against the second jaw, in the engagement condition, a button that is meant to close, in case of engagement with said second jaw, said electrical contact between said two conducting wires.

10. The device according to claim 1, wherein said second jaw comprises, at the surface that is meant to engage said first jaw, a slot that is meant, in the restraining condition, to accommodate said portion of said cable.

11. The device according to claim 1, wherein said surface meant to engage said second jaw, in the restraining condition, comprises means for adjusting the distance from said second jaw.

12. The device according to claim 1, wherein said adjustment means comprise a screw.

13. The device according to claim 1, wherein said first jaw and said second jaw comprise mutual engagement means that is suitable to lock said clamping element in the restraining condition.

14. The device according to claim 13, wherein said mutual engagement means comprises an engagement tooth that is arranged on said second jaw and a locator arranged at said first jaw.

15. The anti-theft device according to claim 1, wherein an adhesive tab is associated with said clamping element.

16. The anti-theft device according to claim 1, wherein said detachable engagement means comprises an indicator that is suitable to indicate operating anomalies.

17. The anti-theft device according to claim 16, wherein said indicator comprises a LED.

18. The device according to claim 1, wherein said loading means comprise a single spring that can be accommodated in an internal cavity of said spool and is in sliding electrical contact with two terminals that are electrically connected to said control unit.

19. The device according to claim 1, wherein said loading means comprise two coiled springs that can be accommodated in a respective seat provided inside said spool, each spring having one end electrically connected to a conductor of said cable and the other end connected electrically without sliding to said control unit.

20. The device according to claim 1, wherein said control unit comprises remote transmission means for activating a remote signaling or alarm system.

21. The device according to claim 1, wherein said spool rotates around a shaft supported by a supporting bracket that can be fixed to a support.

22. The device according to claim 21, wherein said support is constituted by a stand that comprises a rear supporting portion and a front that can be applied with a snap action to the rear portion, so as to delimit a compartment for containing one or more spools for winding-unwinding a respective cable.

23. The device according to claim 22, wherein said front comprises a bush for the passage of the or each cable, said bush also acting as a support for an item to be displayed.

24. The device according to claim 21, wherein said support comprises a plurality of columns arranged side by side.

25. The device according to claim 21, wherein said support has a star-like configuration.

26. An anti-theft device, comprising at least one flexible cable provided with two conducting wires that are connected, at a first end, to means for detachable engagement with at least one item to be restrained and are suitable to open or close an electrical contact between said two conducting wires and are connected, at their other end, to a control unit that is meant to act in response to the opening/ closure of said electrical contact, a removable engagement means comprising a clamping element for locking, with respect to said first end, a portion of said cable in order to form a restraining loop, wherein said clamping element comprises two clamping jaws which are mutually articulated in order to pass from an engagement condition, in which said portion of said cable can move with respect to said first end, to a restraining condition, in which said portion of said cable is in a locking position and said electrical contact is closed.

27. The device according to claim 26, wherein said flexible cable has a high pulling strength and comprises two conducting wires, which end, at the free end of said cable, with a respective mutual engagement means.

28. The device according to claim 27, wherein each conductor of said cable comprises a plurality of strands having a very small diameter and an insulation and protection sheath.

29. The anti-theft device according to claim 26, wherein said conducting wires are connected to a first one of said two jaws.

30. The anti-theft device according to claim 26, wherein said portion of said cable, in the restraining condition, is at least partially associated with a closure lamina that is slidingly coupled to a second jaw, a sliding of said portion of said cable suitable to widen said restraining loop producing a sliding of said lamina and the opening of said electrical contact.

31. The anti-theft device according to 30, wherein said lamina comprises, at the face that is meant to face said first jaw, a stud for engaging a button, formed on said second jaw, for closing said electrical contact.

32. The anti-theft device according to claim 30, further comprising elastic means that are interposed between said lamina and said second jaw, act along a direction that is substantially parallel to the direction of the sliding of said lamina with respect to said second jaw, and are meant to keep said lamina, in the restraining condition, in the position for closing said electrical contact.

33. The anti-theft device according to claim 26, wherein said detachable engagement means comprises an indicator that is suitable to indicate operating anomalies.

34. The anti-theft device according to claim 33, wherein said indicator comprises a LED.

35. The anti-theft device according to 26, wherein an adhesive tab is associated with said clamping element.

36. The device according to claim 29, wherein said first jaw comprises, at the surface meant to abut against the second jaw, in the engagement condition, a button that is meant to close, in case of engagement with said second jaw, said electrical contact between said two conducting wires.

37. The device according to 36, wherein said second jaw comprises, at the surface that is meant to engage said first jaw, a slot that is meant, in the restraining condition, to accommodate said portion of said cable.

38. The device according to claim 37, wherein said surface meant to engage said second jaw, in the restraining condition, comprises means for adjusting the distance from said second jaw.

39. The device according to claim 38, wherein said adjustment means comprise a screw.

40. The device according to claim 36, wherein said first jaw and said second jaw comprise mutual engagement means that is suitable to lock said clamping element in the restraining condition.

41. The device according to claim 40, wherein said mutual engagement means comprises an engagement tooth that is arranged on said second jaw and a locator arranged at said first jaw.

42. An anti-theft device, comprising at least one spool made of electrically insulating material that is mounted rotatably on a support; at least one cable having two conductors that can be wound onto, and unwound from, said spool or a respective spool and has a free end that can be detachably anchored to an item to be restrained, elastic loading means for the or each spool in order to ensure the automatic tensioning and rewinding of said cable on its own spool, detachable engagement means for an item to be restrained which is located at said free end of said cable or of each cable and is suitable to open or close an electrical contact, and a control unit that is meant to act in response to the opening-closing of said electrical contact, wherein said detachable engagement means comprises an elastically loaded telescopic tube, which has a transverse seat that acts as a socket for accommodating a plug and is electrically connected to a conductor of said cable, and a plug that can be inserted in said socket, is electrically connected to the other conductor of said cable, and has a head for abutment against the passage of said telescopic tube.

43. The device according to claim 42, wherein said cable has a high pulling strength and comprises two conducting wires, which end, at the free end of said cable, with a respective mutual engagement means.

44. The device according to claim 43, wherein each conductor of said cable comprises a plurality of strands having a very small diameter and an insulation and protection sheath.

45. The device according to claim 42, wherein said cable, said elastic loading means, said detachable engagement means and said control unit constitute an electric circuit that can be opened/closed at said detachable engagement means.

46. The device according to claim 42, wherein said loading means comprise a single spring that can be accommodated in an internal cavity of said spool and is in sliding electrical contact with two terminals that are electrically connected to said control unit.

47. The device according to claim 42, wherein said loading means comprise two coiled springs that can be accommodated in a respective seat provided inside said spool, each spring having one end electrically connected to a conductor of said cable and the other end connected electrically without sliding to said control unit.

48. The device according to claim 42, wherein said control unit comprises remote transmission means for activating a remote signaling or alarm system.

49. The device according to claim 42, wherein said spool rotates around a shaft supported by a supporting bracket that can be fixed to a support.

50. The device according to claim 49, wherein said support is constituted by a stand that comprises a rear supporting portion and a front that can be applied with a snap action to the rear portion, so as to delimit a compartment for containing one or more spools for winding-unwinding a respective cable.

51. The device according to claim 50, wherein said front comprises a bush for the passage of the or each cable, said bush also acting as a support for an item to be displayed.

52. The device according to claim 49, wherein said support comprises a plurality of columns arranged side by side.

53. The device according to claim 49, wherein said support has a star-like configuration.

* * * * *